United States Patent [19]

Stewart

[11] Patent Number: 5,034,575

[45] Date of Patent: Jul. 23, 1991

[54] MULTI-POSITION ROTARY SWITCH WITH ACTUATOR BLOCKING DEVICE AND INDICATOR

[75] Inventor: J. Steve Stewart, Birmingham, Ala.

[73] Assignee: Electrical Equipment, Inc., Birmingham, Ala.

[21] Appl. No.: 484,245

[22] Filed: Feb. 26, 1990

[51] Int. Cl.[5] ..... H01H 19/10; H01H 9/00

[52] U.S. Cl. ..... 200/11 R; 200/14; 200/17 R; 200/308

[58] Field of Search ..... 200/11 R, 11 G, 11 J, 200/11 TC, 14, 15, 17 R, 18, 308, 327, 336

[56] References Cited

U.S. PATENT DOCUMENTS 3,742,158 6/1973 Bell et al. ..... 200/17 R X 4,532,386 7/1985 Muench, Jr. et al. ..... 200/336 X

*Primary Examiner*—J. R. Scott

*Attorney, Agent, or Firm*—Jennings, Carter, Thompson & Veal

[57] ABSTRACT

A blocking device for selectively restricting the movement of a multi-position electric switch between predetermined closed positions without restricting the switch's movement to an open non-conducting position. The blocking device includes a restrictive arm which can be quickly and easily connected or disengaged from the switch and further includes a retainer for insuring correct connection of the arm to the switch. The blocking device also serves as an indicator of the position currently occupied by the switch.

13 Claims, 5 Drawing Sheets

Fig. 4
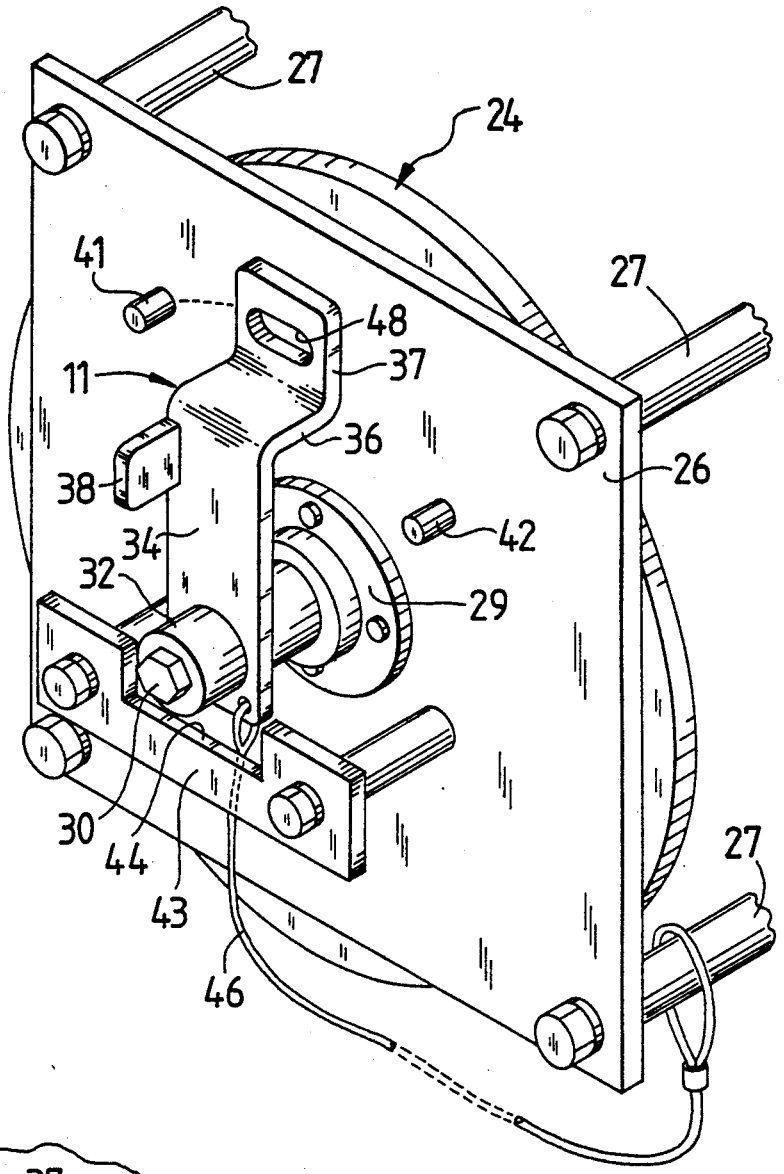
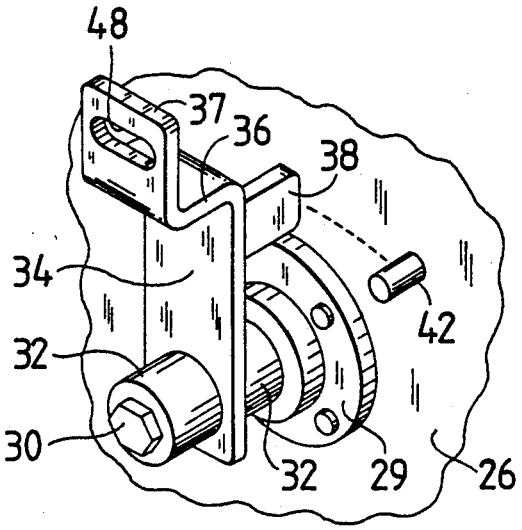
Fig. 5

MULTI-POSITION ROTARY SWITCH WITH ACTUATOR BLOCKING DEVICE AND INDICATOR

FIELD OF THE INVENTION

The present invention relates to electromechanical switchgear and more particularly to a mechanism for blocking the movement of a switch gear or the like selectively from one of a number of predetermined positions. More particularly the present invention relates to a restrictive arm which can be connected to the switchgear in a plurality of selected positions for pivotal movement therewith, wherein the arm in each selected position is restricted to a different field of movement by a plurality of interfering pins.

BACKGROUND OF THE INVENTION

In the field of electromechanical switchgear, prior industry practice requires that some form of blocking device be incorporated in a switchgear's operating system to prevent the switchgear operator from inadvertently connecting an energized feeder line to a ground.

Typically, such switchgear has a plurality of pivotal blades which are connected to an incoming energized feeder line. The blades are pivoted between three positions, two of which connect the blades and consequently the feeder line to conductive terminals and one in which the circuit remains open. The switchgear can be utilized in reverse fashion to selectively connect two feeder lines to an outgoing circuit wherein the outgoing circuit is connected to the pivoting blades. Depending on how the switchgear is utilized, it may be necessary to restrict the movement of the blades from contact with one or the other conductive terminals. For instance, if the switchgear is used in a public utility's electric service circuit, the inadvertent switching of the blades and consequently the energized feeder line to a ground terminal could open other protective devices in the circuit thereby turning off power to users.

Blocking devices are commonly used to insure that the switchgear not be thrown to an undesirable position. These devices include blocking cams operatively connected to the switchgear which are locked in place by padlocks once the blades are pivoted to a chosen operating position. The problem with these blocking devices is that should the switch operator forget to connect the padlock or connect the padlock incorrectly, the blocking device is rendered useless in preventing inadvertent switching of the blades to an undesirable position. Should the operator need to quickly switch the blades to an open position, the use of padlocks could hinder such action as padlocks require a substantial time period for disengagement and a correct set of keys.

SUMMARY OF THE PRESENT INVENTION

It is the principal object of the present invention to provide a blocking device which can be connected to a multi-positional electric switchgear for selectively restricting the movement thereof between predetermined conductive positions without restricting the movement of the switchgear to an open position.

In support of the principal object, another object of the present invention is to provide a blocking device that is quickly and easily disengaged from the switchgear.

Yet another object of the present invention is to provide means for insuring that such a blocking device is correctly connected to the switchgear.

And still another object of the present invention is to provide a blocking device which indicates the position currently occupied by the switchgear.

These and other objects and advantages of the present invention are accomplished through the use of a restrictive arm having a plurality of stop portion's distributed thereon. The arm is connected to a switch operating mechanism which pivots the switchgear's blades to any of three available positions. The restrictive arm can be connected to the operating mechanism in a variety of positions, the selection of which consequently determines the range of movement the switchgear is permitted to operate within.

BRIEF DESCRIPTION OF THE DRAWINGS

Apparatus embodying features of our invention are depicted in the accompanying drawings which form a portion of this disclosure and wherein:

FIG. 4 is a perspective view of the present invention operatively connected in a forward position to switch operating mechanism of a multi-position electric switchgear;

FIG. 5 is a detailed perspective view showing a restrictive arm operatively connected in a reverse position to a switch operating mechanism;

DESCRIPTION OF A PREFERRED EMBODIMENT

Figure 1:
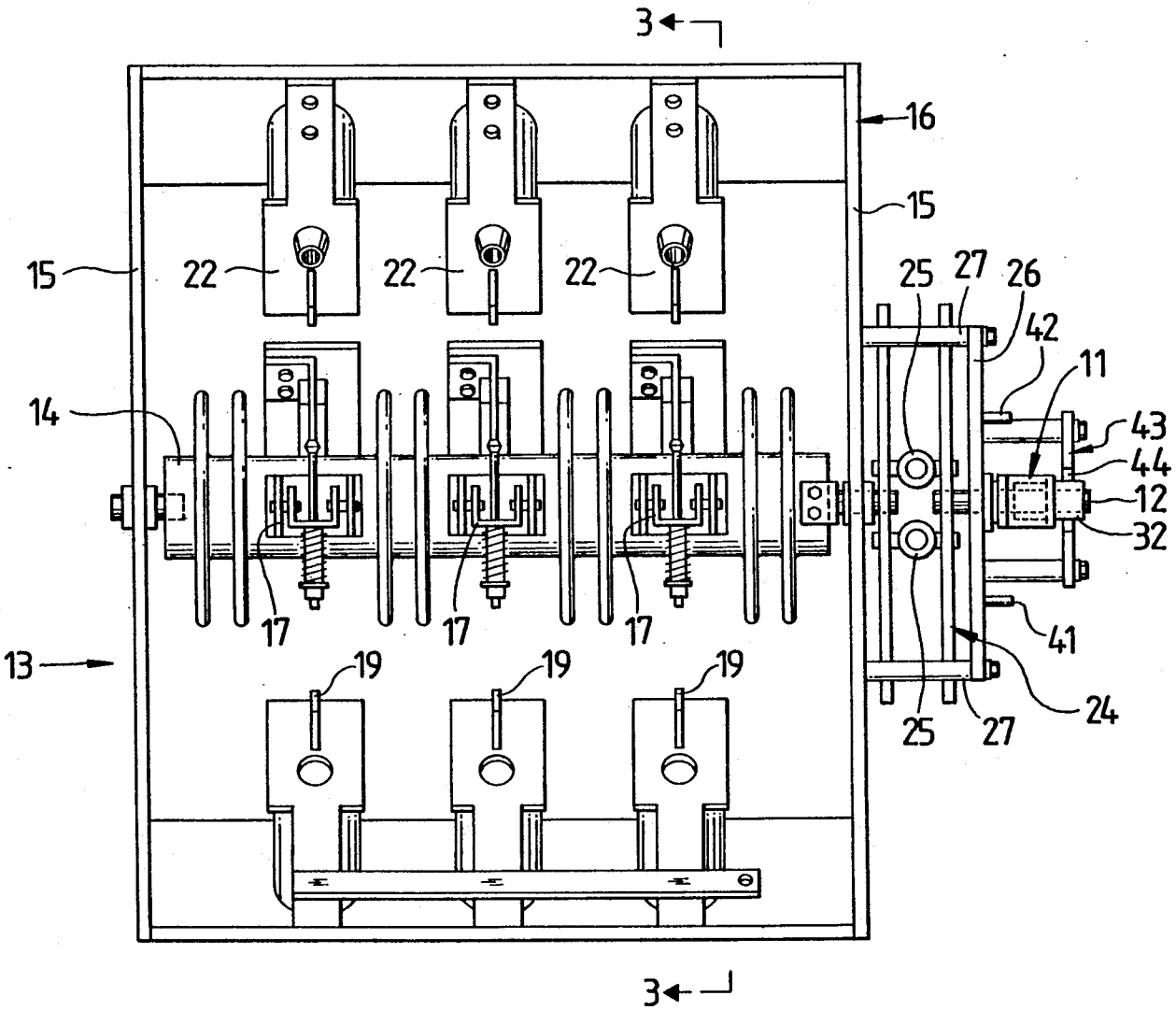
FIG. 1 is an elevational view of a multi-position electric switchgear with the present invention operatively connected thereon.
Figure 3:
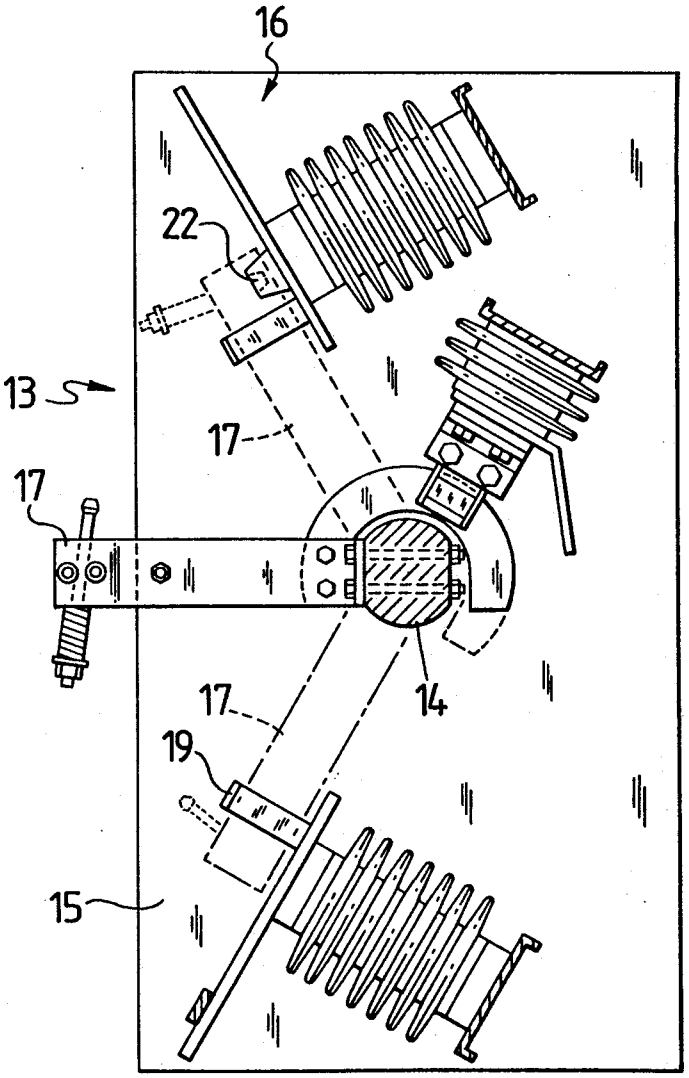
FIG. 3 is a sectional view taken along line 3—3 of FIG. 1.

Referring to drawings 1–8 for a clearer understanding of the invention, it should be noted that the present invention contemplates the use of a restrictive arm 11 detachably connected to an input shaft 12 extending from switchgear 13. As shown in FIGS. 1 and 3, the switchgear 13 includes a shaft 14 mounted to two opposing sidewalls 15 of a switch housing 16 in normal extension therethrough for pivotal movement about a horizontal axis. Mounted to shaft 14 in perpendicular extension therefrom are three blades 17 which when pivoted downward as shown in FIG. 3, will contact a set of ground contacts 19, thereby assuming a grounded position and when pivoted upward, will contact a set of circuit closed contacts 22, thereby assuming a closed position. When pivoted an equal distance between the grounded and closed position, the blades 17 assume an open position. The shaft 14 is operatively connected to a switch operating mechanism (generally indicated as 24) which includes the input shaft 12. The input shaft 12 and the shaft 14 lie along a common axis with the input shaft 12 being mounted to an outer panel 26 of the switch housing 16 in normal extension therethrough.

The outer panel 26 is mounted in spaced relation to one of the sidewalls 16 by four extension members 27.

Figure 6:
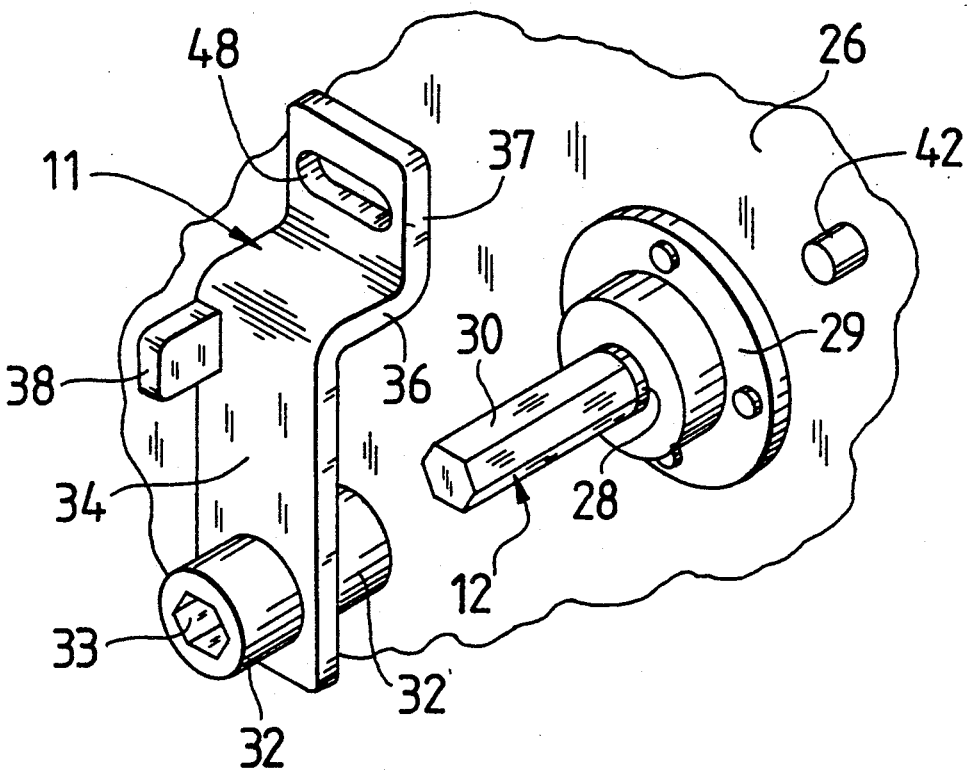
FIG. 6 is an exploded perspective view showing the restrictive arm removed from an input shaft.
Figure 8:
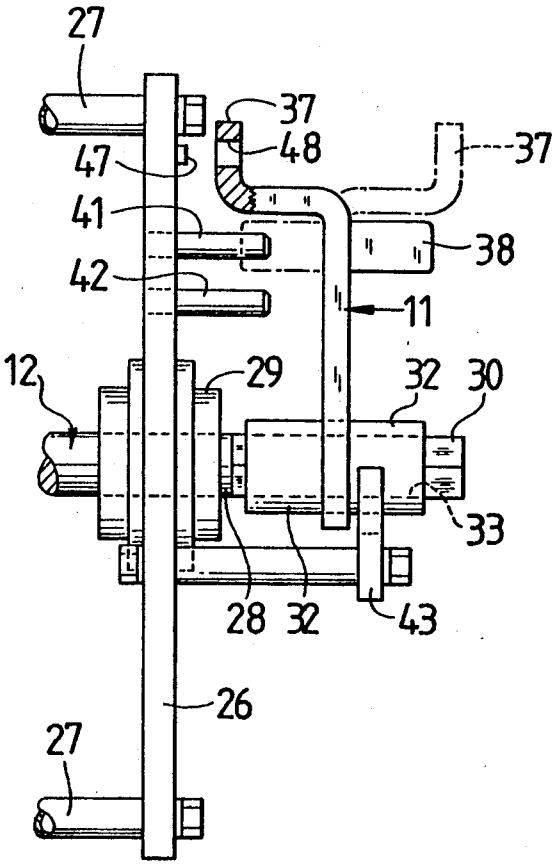
FIG. 8 is a side elevational view of the present invention as viewed along line 8—8 of FIG. 7.

As shown in FIG. 6, the input shaft 12 includes a rounded portion 28 mounted to the outer panel 26 by a bearing assembly 29 and a hexagonal portion 30 connected to the rounded portion 28 in co-axial extension therefrom. The input shaft 12 may be grasped and rotated by an appropriate device such as a lever or motor, such rotation subsequently resulting in similar rotation of the shaft 14 via the operating mechanism 24. Therefore, to pivot the blades 17 to grounded, open or closed positions, the input shaft 12 must first be rotated to grounded, open or closed positions respectively. Once the input shaft 12 is rotated to a selected position, springs 25 included in the operating mechanism 24 are activated to pivot the shaft 14 and the blades 17 to the same position. As shown in FIG. 4, the restrictive arm 11 is connected in a forward position to the hexagonal portion 30 of the input shaft 26 and as shown in FIGS. 5 and 8, can be removed therefrom, rotated 180° about its longitudinal axis and reconnected in a reverse position.

Figure 2:
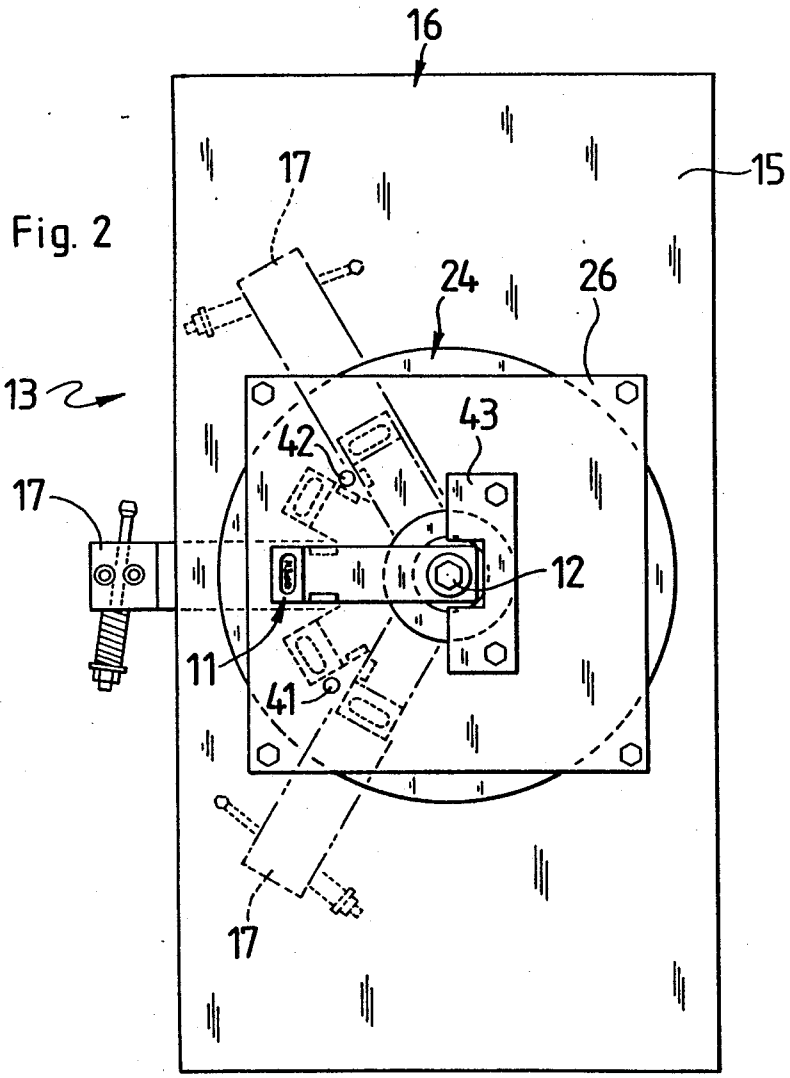
FIG. 2 is a side elevational view of a multi-position electric switchgear with the present invention operatively connected thereon.
Figure 7:
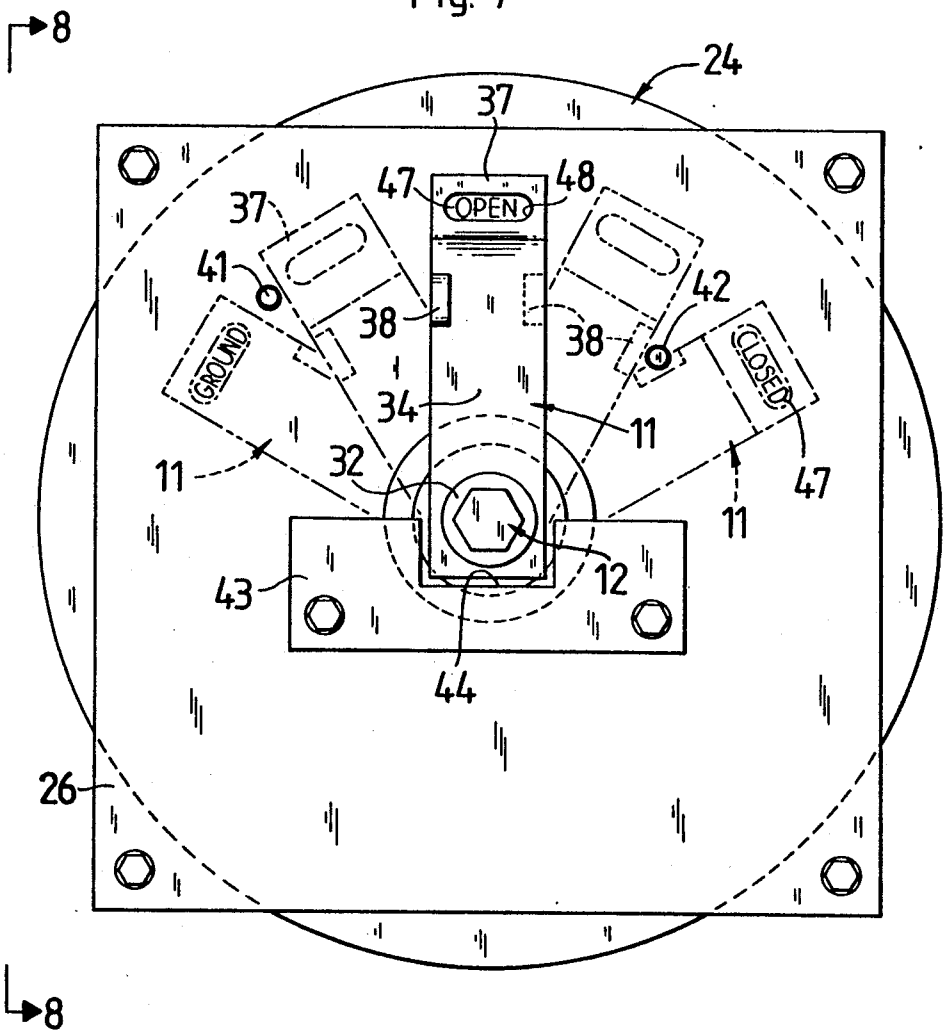
FIG. 7 is a side elevational view of the present invention showing the restrictive arm in various positions.

The restrictive arm 11, when connected to the input shaft 12 in either a forward or reverse position, extends parallel to the blades 17 in an open position. As shown in FIG. 6, the restrictive arm 11 includes a cylindrical hub 32 which defines a hexagonal channel 33 therein to receive the hexagonal portion 30 of the input shaft 12. The arm 11 also includes a first plate portion 34 which is connected to the hub 32 in perpendicular extension therefrom, a second plate portion 36 connected to the extended marginal edges of the first plate portion 34 in perpendicular extension therefrom. A first stop portion 37 is connected to the extended marginal edge of the second plate portion 36 in perpendicular extension therefrom and a second stop portion 38 is connected to the first plate portion 34 in perpendicular extension therefrom away from the second plate portion 36. As shown in FIG. 4, a first interferenoe pin 41 is connected to the outer panel 26 of the switchgear at a first predetermined point along the path the first stop portion 37 travels when the restricting arm 11 is in the forward position and the input shaft 12 is pivoted from an open to a ground position. FIG. 5 shows a second interference pin 42 connected to the outer panel 26 at a second predetermined point along the path the second stop portion 38 travels when the restrictive arm 11 is in the reverse position and the input shaft 12 is pivoted from an open to a closed position. As shown in FIGS. 2, 4, and 7, a retainer 43 is mounted in spaced relation to said outer panel 26 by rods **43*a* connected intermediate and extending normally thereto and is centered about the input shaft 12. The retainer 43 carries a slot 44 which mirrors the lower marginal edges of the first plate portion 34 and permits disengagement of the restrictive arm 11 from the operating shaft 26 when the input shaft is in an open position. A tether line 46 is connected intermediate one of the extension member 27 and the restrictive arm 11**.

In operation, the switch 13 is placed in an open position and the restrictive arm 11 is connected to the input shaft 12 by engaging the hexagonal portion 30 within the hexagonal channel 33. The restrictive arm 11 can only be connected to the input shaft 12 in an upright position as the lower end of the first plate portion 34 must pass through the slot 44 of retainer 43 before the input shaft 12 can be engaged within the hub 32. The hexagonal characteristics of the channel 33 and the hexagonal portion 30 of input shaft 12 prevent the restrictive arm 11 from pivoting about the input shaft 12.

For the input shaft 12 to be prevented from pivoting to a ground position the restrictive arm 11 must engage the shaft 26 in a forward position. FIGS. 2 and 3 show that if the restrictive arm 11 is connected to the input shaft 12 in a forward position and the input shaft 12 is pivoted toward a ground position, the first stop member 37 will contact the first interference pin 41, thereby restricting the movement of the restricting arm 11 which in turn prevents the blades 17 from contacting the ground contacts 19. When the restrictive arm 11 is connected to the input shaft 12 in a forward position and the input shaft 12 is pivoted toward a closed position the second plate portion 36 and the first stop member 37 will pass over the second interference pin 42 and the restrictive arm 11 will move toward the closed position unhindered, thereby allowing the blades 17 to contact the circuit closed contacts 22.

To prevent the blades 17 from pivoting to a closed position, the restrictive arm 11 must be connected to the input shaft 12 in a reverse position. If the restrictive arm 11 is connected to the input shaft 12 in a reverse position and the input shaft 12 is pivoted toward a closed position, the second stop member 38 will contact the second interference pin 42, thereby restricting the movement of the restrictive arm 11 which in turn prevents the blades 17 from contacting the circuit closed contacts 22. When the restrictive arm 11 is connected to the input shaft 12 in a reverse position and the input shaft 12 is pivoted toward a ground position, the second plate portion 36 and the second stop member 38 will pass below the first interference pin 41 allowing the restrictive arm 11 to pivot unhindered, thereby allowing the blades 17 to contact the ground contacts 19. As shown in FIG. 7, indicia 47 connected to the outer panel 27 indicate which position the blades 17 are in when viewed through a window 48 extending through the first stop member 37, thus the human operator can see which switch operator is blocked by my device.

While I have shown my invention in one form, it will be obvious to those skilled in the art that it is not so limited but is susceptible of various changes and modifications without departing from the spirit thereof.

What I claim is:

1. An apparatus for selectively restricting the movement of a multi-positional electric switch having an input shaft rotably mounted to and extending normally through an outer panel mounted to said multi-positional electric switch, comprising:

(a) a restrictive arm selectively connected in a forward position to said input shaft, wherein said restrictive arm can be removed from said input shaft, rotated 180 degrees about its longitudinal axis, and reconnected to said input shaft in a reverse position, wherein said restrictive arm is asymmetrically configured and has a portion thereof which extends proximal the outer panel over only a first radial distance from said input shaft when said restrictive arm is in said forward position and a second portion which extends proximal said outer panel over only a second radial distance from said input shaft when said restrictive arm is in said reverse position;

(b) a first interference pin mounted to and extending outwardly from said outer panel of said switch, wherein said first interference pin is spaced within said first radial distance from said input shaft and is engaged by said restrictive arm only when said input shaft is rotated in a first direction and said restrictive arm is connected to said input shaft in said forward position; and (c) a second interference pin mounted to and extending outwardly from said outer panel of said switch, wherein said second interference pin is spaced within said second radial distance from said input shaft and is engaged by said restrictive arm only when said input shaft is rotated in a second direction and said restrictive arm is connected to said input shaft in said reverse position, wherein said restrictive arm is not restricted by said second interference pin when said restrictive arm is connected to said input shaft in said forward position, restricted by said first interference pin when connected to said input shaft in said forward position.

2. Apparatus as described in claim 1 further comprising retainer means mounted in spaced relation to said switch by a plurality of rods connected to and extending normally to said outer panel and said retainer, wherein said retainer is centered about said input shaft, for preventing removal of said restrictive arm from said input shaft except when said restrictive arm is pivoted by the rotation of said input shaft to a predetermined position.

3. Apparatus as described in claim 2 wherein said restrictive arm comprises:

(a) a cylindrical hub defining a axial channel for receiving said input shaft therein;

(b) a first plate portion connected to said hub in perpendicular extension therefrom;

(c) a second plate portion connected to said first plate portion in perpendicular extension therefrom;

(d) a first stop member connected to said second plate portion in perpendicular extension therefrom; and (e) a second stop member connected to said first plate portion being located thereon a predetermined distance from said second plate portion in opposing extension therefrom.

4. Apparatus as described in claim 3 wherein said first stop member will contact said first interference pin only when said input shaft is pivoted in said first direction and when said restrictive arm is connected to said input shaft in said forward position.

5. Apparatus as described in claim 3 wherein said second stop member will contact said second interference pin when said input shaft is pivoted in said second direction and when said restrictive arm is connected to said input shaft in a reverse position.

6. Apparatus as described in claim 3 wherein said retainers means defines a slot which mirrors the lower end of said first plate portion, said slot being centered around said input shaft thereby permitting disconnection and reconnection of said restrictive arm when said restrictive arm is in a predetermined position.

7. Apparatus as described in claim 3 wherein said first stop member defines a window through which indicia connected to said outer panel are visible, wherein said indicia when viewed through said window are indicative of the current position occupied by said switch.

8. An apparatus for selectively restricting the movement of a multi-positional switch having a first shaft mounted in normal extension through opposing sides of a switch housing, a second shaft mounted to an outer panel of said switch housing being operatively connected to said first shaft by a switch operating mechanism connected to said outer panel, said input shaft, and said second shaft, and a plurality of parallel blades connected in perpendicular extension from said first shaft which pivot therewith to grounded, open and closed position, comprising:

(a) a restrictive arm selectively connected to said second shaft in either a forward or reverse position;

(b) first means connected to said outer panel for restricting the movement of said arm only when said blades are pivoted toward a grounded position and said arm is selectively connected in said forward position; and (c) second means connected to said outer panel for restricting the movement of said arm only when said blades are pivoted toward a closed position and said arm is selectively connected to said second shaft in said reverse position.

9. Apparatus as described in claim 8 further comprising a retainer mounted in spaced relation to said outer panel by a plurality of rods connected to and extending outwardly from said outer panel and said retainer, wherein said retainer is centered about said second shaft preventing removal of said restrictive arm from said second shaft except when said blades are in said open position.

10. Apparatus as described in claim 9 wherein said restricting arm comprises:

(a) a cylindrical hub defining a passage extending therethrough for receiving said second shaft in non-pivoting engagement therein;

(b) a first plate portion connected to said hub in perpendicular extension therefrom;

(c) a first stop member connected to said first plate portion for contacting said first restricting means when said restrictive arm is connected to said second shaft in said forward position.

(d) a second stop member connected to said plate portion in opposite extension from said first stop member for contacting said second restricting means when said restrictive arm is mounted to said second shaft in said reverse position.

11. Apparatus as described in claim 10 wherein said passage and said second shaft are cross-sectionally hexagonal.

12. Apparatus as described in claim 10 where said retainer carries a slot which mirrors the lower end of said first plate portion, said slot being centered around said second shaft to prevent disconnection of said restrictive arm from said second shaft except when said blades are in an open position.

13. Apparatus as described in claim 10 wherein said first stop member defines a window through which indicia connected to said housing are visible, wherein each said indicia when viewed through said window is indicative of the current position of said blades.

* * * * *